US005586539A

United States Patent [19]

Yonekawa et al.

[11] Patent Number: 5,586,539

[45] Date of Patent: Dec. 24, 1996

[54] FUEL SUPPLYING APPARATUS FOR INTERNAL COMBUSTION ENGINE

[75] Inventors: Masao Yonekawa, Kariya; Kazuji Minagawa, Tokoname; Kiyotoshi Oi, Toyohashi; Makoto Miwa, Kariya; Yoshihiro Majima, Obu, all of Japan

[73] Assignee: Nippondenso Co., Ltd., Kariya, Japan

[21] Appl. No.: 587,447

[22] Filed: Dec. 1, 1995

[30] Foreign Application Priority Data

Dec. 20, 1994 [JP] Japan ..... 6-315426

[51] Int. Cl.[6] ..... F02M 37/08

[52] U.S. Cl. ..... 123/458; 123/491; 123/497

[58] Field of Search ..... 123/179.15, 456, 123/458, 464, 491, 497

[56] References Cited

U.S. PATENT DOCUMENTS

| | | | |
|---|---|---|---|
| 3,967,598 | 7/1976 | Rachel | 123/447 |
| 4,404,944 | 9/1983 | Yamazaki et al. | 123/458 |
| 4,565,173 | 1/1986 | Oshiage et al. | 123/458 |
| 4,635,606 | 1/1987 | Koike et al. | 123/459 X |
| 4,671,240 | 6/1987 | Tanaka et al. | 123/179.17 X |
| 5,111,796 | 5/1992 | Ogita | 123/458 X |
| 5,237,975 | 8/1993 | Betki et al. | 123/497 |
| 5,367,999 | 11/1994 | King et al. | 123/458 |
| 5,425,342 | 6/1995 | Ariga et al. | 123/456 |

FOREIGN PATENT DOCUMENTS

| | | |
|---|---|---|
| 4-232371 | 9/1992 | Japan . |
| 5-125984 | 5/1993 | Japan . |

*Primary Examiner*—Tony M. Argenbright
*Attorney, Agent, or Firm*—Cushman, Darby & Cushman

[57] ABSTRACT

A fuel supplying apparatus controls fuel pressure according to engine operating conditions to prevent blow-through of injected fuel into the exhaust system and hyper-vaporization of fuel. When the engine is being started and the fuel temperature is high, or when the engine has just started and the fuel temperature is high, a target fuel pressure is determined according to the fuel temperature. When a predetermined time has elapsed following the starting of the engine, or when the fuel temperature is not high (even if the predetermined time has not elapsed), it is determined whether fuel vapor is being purged from a canister into an intake pipe. The canister traps fuel vapor from a fuel tank. If the fuel purging is being performed, the apparatus determines whether the current engine operation is in a low-load region. If the fuel purging is being performed and the engine operation is in the low-load region, the apparatus computes a target fuel pressure according to the fuel purging conditions. If the fuel purging is not being performed, or if the engine operation is not in the low-load region, the target fuel pressure is determined as a basic target fuel pressure.

16 Claims, 12 Drawing Sheets

$H_2O$ TEMP.

AIR TEMP.

| (°C) \ (°C) | 60 | 70 | 80 | 90 |
|---|---|---|---|---|
| 60 | 250 kpa | 250 | 270 | 290 |
| 70 | 250 | 260 | 280 | 300 |
| | | | | |

FIG. 5

ENGINE SPEED

INTAKE AIR QUANT.

| (m³/h) \ (rpm) | 500 | 1000 | 1500 | 2000 |
|---|---|---|---|---|
| 5 | -70 kpa | -72 | -74 | -74 |
| 10 | -60 | -62 | -64 | -65 |
| | | | | |

FIG. 13

ENGINE SPEED

INTAKE AIR QUANT.

| (m³/h) \ (rpm) | 500 | 1000 | 1500 | 2000 |
|---|---|---|---|---|
| 5 | 200 kpa | 205 | 210 | 215 |
| 10 | 202 | 207 | 212 | 217 |
| | | | | |

FIG. 14

FUEL SUPPLYING APPARATUS FOR INTERNAL COMBUSTION ENGINE

BACKGROUND OF THE INVENTION

1. Field of the Invention

The present invention relates to a fuel supplying apparatus for an internal combustion engine in which an improvement is made in the mechanism for adjusting the pressure of fuel conveyed from a fuel pump to a fuel injector.

2. Description of the Related Art

In a conventional fuel injection system as shown in FIG. 15, fuel is supplied from a fuel tank 1 to a fuel injector 3 by a fuel pump 2, and is injected from the injector 3 into an engine 4. The pressure of fuel conveyed form the fuel pump 2 to the injector 3 is adjusted by a pressure regulator 5 to maintain a predetermined pressure difference with respect to the intake pipe pressure. The conventional system also comprises a return pipe 6 for returning surplus fuel to the fuel tank 1.

Because the predetermined pressure difference between the fuel pressure and the intake pipe pressure is maintained by the pressure regulator 5, the quantity of fuel injected into the engine 4 (hereinafter, referred to as "fuel injection quantity") is proportional to the length of a pulse (injection pulse) applied to the injector 3, as indicated in FIG. 6. Therefore, in high-load engine operation where the fuel injection quantity is increased, the length of injection pulses is increased, as illustrated in FIG. 7B. In addition, because the injection timing of the injector 4 is synchronized with the engine speed, for example, one or two injections per combustion cycle, the length of an injection period decreases as the engine speed increases. Thus, injection intervals become significantly short in high-speed and high-load engine operation.

Normally, if fuel is injected during an intake stroke, so-called "blow-through" occurs during a valve overlap period when intake and exhaust valves are open, that is, fuel injected immediately goes into the exhaust system. To avoid this undesired event, fuel injection should be completed before the intake stroke starts. However, since injection intervals are short in high-speed and high-load engine operation as described above, injection will very likely continue into the intake stroke period (see the shaded portion of FIG. 7B) in such engine operation, and the blow-through of injected fuel will occur, thus resulting in an undesired emission composition having a significantly large amount of unburned gas. If the injector 3 is increased in size to shorten injection pulses in the high-load engine operation, injection pulses in low-load engine operation will become too short. Excessively short injection pulses degrade the fuel injection quantity controllability. As indicated by the dotted line in FIG. 6, if the length of injection pulses applied to the injector 3 becomes less than the lower linearity limit, the fuel injection quantity cannot be reliably controlled.

It is also known that in a case where the engine is restarted after high-load engine operation under high-temperature conditions, the engine startability is deteriorated by the accelerated fuel vaporization (hereinafter, referred to as "hyper-vaporization"). A method to prevent the hyper-vaporization is disclosed in Japanese Patent Laid-Open Publication No. Hei. 5-125984, in which the fuel pressure is increased relative to the pressure in the intake pipe 7 by ceasing introduction of the intake pressure into the pressure regulator 5. However, ceasing introduction of the intake pressure into the pressure regulator can achieve only a limited increase of fuel pressure, resulting in rather insufficient mitigation of hyper-vaporization. Furthermore, this conventional fuel supply system needs to employ a pressure regulator 5 and a return pipe 6 for returning surplus fuel to the fuel tank 1, thus requiring a complicated piping arrangement.

SUMMARY OF THE INVENTION

The present invention is intended to solve the above-stated problems of the conventional art. It is an object of the invention to provide a fuel supplying apparatus for an internal combustion engine that eliminates the need for a return pipe or a pressure regulator, thus simplifying the piping arrangement, automatically adjusts the fuel pressure in accordance with operating conditions of the engine, substantially prevents the blow-through and the hyper-vaporization, and achieves fuel injection control with an ample margin relative to the linearity limit with respect to the length of injection pulses.

According to the present invention, a fuel supplying apparatus for an internal combustion engine (hereinafter, referred to as "engine") supplies fuel from a fuel tank to an injector by using a fuel pump and injects fuel from the injector into the engine. The apparatus includes a variable speed driving unit variably controlling pumping pressure of the fuel pump, a temperature information detecting unit detecting information regarding fuel temperature, and a fuel pressure control unit controlling the variable speed driving unit so that the pressure of fuel to be injected by the injector becomes substantially equal to a fuel pressure determined in accordance with an operating condition of the engine and the fuel temperature determined by the temperature information detecting unit.

Since the apparatus of the invention variably controls the pumping pressure of the fuel pump to adjust the pressure of fuel to a target fuel pressure, the apparatus allows for a simple piping arrangement in which the conventional return pipe and pressure regulator are omitted, and it can variably control the pressure of fuel in accordance with engine operating conditions, thus expanding the controllable engine operating regions.

It is preferred that the fuel pressure control unit include a unit for controlling the variable speed driving unit so that when the fuel temperature determined by the temperature information detecting unit equals or exceeds a predetermined value, the pressure of fuel to be injected becomes substantially equal to a fuel pressure determined in accordance with at least the fuel temperature. With this construction, the pressure of fuel is automatically controlled in accordance with the fuel temperature.

It is also preferred that the fuel pressure control unit include a unit for controlling the variable speed driving unit so that as the fuel temperature determined by the temperature information detecting unit increases, the pressure of fuel to be injected increases. Since fuel vaporization occurs more readily if the fuel temperature is higher or if the fuel pressure is lower, this fuel pressure control unit will efficiently reduce vaporization of fuel.

According to another preferred construction, the apparatus may further comprise a high-temperature restart determining unit for determining whether the current operation of the engine corresponds to a high-temperature restarting operation. In addition, the fuel pressure control unit may include a unit for controlling the variable speed driving unit so that when the high-temperature restart determining unit determines that the current operation of the engine corresponds to the high-temperature restarting operation, the pressure of fuel to be injected becomes substantially equal to a fuel pressure determined in accordance with at least the fuel temperature determined by the temperature information detecting unit, and then, as the fuel temperature decreases, the pressure of fuel to be injected gradually decreases. With this construction, the fuel vaporization is effectively reduced in the high-temperature restarting operation, thus improving the engine startability.

According to a further preferred construction, the apparatus may further comprise a fuel injection timing determining unit for determining whether fuel injection end timing is earlier than intake valve opening timing. In addition, the fuel pressure control unit may include a unit for controlling the variable speed driving unit so that when the injection timing determining unit determines that the fuel injection end timing is later than the intake valve opening timing, the pressure of fuel to be injected becomes substantially equal to a fuel pressure that allows the fuel injection end timing to become earlier than the intake valve opening timing. With this construction, fuel injection can be unfailingly completed before the intake stroke starts even in the high-speed and high-load engine operation. This apparatus thus prevents blow-through of injected fuel into the exhaust system and therefore, prevents contamination of unburned gas in the emission.

According to a further preferred construction, the apparatus may further comprise a canister for trapping fuel vapor from the fuel tank and a fuel vapor purging unit for purging fuel vapor from the canister into an intake passage of the engine. In addition, the fuel pressure control unit may include a unit for controlling the variable speed driving unit so that the pressure of fuel to be injected is reduced in accordance with flow of fuel vapor purged by the fuel vapor purging unit. Since this apparatus increases the injection pulse length with a decrease in the fuel pressure, the apparatus performs precise fuel control with an ample margin to the injector linearity limit even if the amount of purged fuel vapor is great.

According to a further preferred construction, the apparatus may further comprise an operating region determining unit for determining whether operation of the engine is in a low-load operating region. In addition, the fuel pressure control unit may include a unit for controlling the variable speed driving unit so that when the operation of the engine is in the low-load operating region, the pressure of fuel to be injected decreases. Conventionally, the fuel injection quantity and the injection pulse are reduced in the low-load operating region. However, with this construction, the injection pulse length is increased by reducing a target fuel pressure in the low-load operation region, thus enabling precise injection control with an ample margin to the injector linearity limit.

It is also preferred that the sensed operating condition of the engine include revolution speed and load of the engine. Based on the engine speed and load, an optimal target fuel pressure can be determined.

It is also preferred that the fuel pressure control unit include a unit for controlling the variable speed driving unit so that as load of the engine increases, the pressure of fuel to be injected increases. With this construction, the apparatus prevents an undesired event in which fuel injection does not end in one stroke during high-load engine operation (when the fuel injection duration is increased, and the time length of each stroke is reduced).

Other objects and features of the invention will appear in the course of the description thereof, which follows.

BRIEF DESCRIPTION OF THE DRAWINGS

The foregoing and further objects, features and advantages of the present invention will become apparent from the following description of preferred embodiments with reference to the accompanying drawings, wherein:

FIG. 5 illustrates a two-dimensional map for determining a target fuel pressure corresponding to given coolant temperature and intake temperature;

FIG. 13 illustrates a two-dimensional map for determining an intake pipe pressure corresponding to given intake air flow and engine speed;

FIG. 14 illustrates a two-dimensional map for determining a fuel pressure corresponding to given engine speed and load according to a fourth embodiment.

DETAILED DESCRIPTION OF THE PRESENTLY PREFERRED EXEMPLARY EMBODIMENTS

The preferred embodiments of the present invention are hereinafter described with reference to the accompanying drawings.

A first embodiment of the fuel supplying apparatus of the invention will be described with reference to the Figures.

Figure 1:
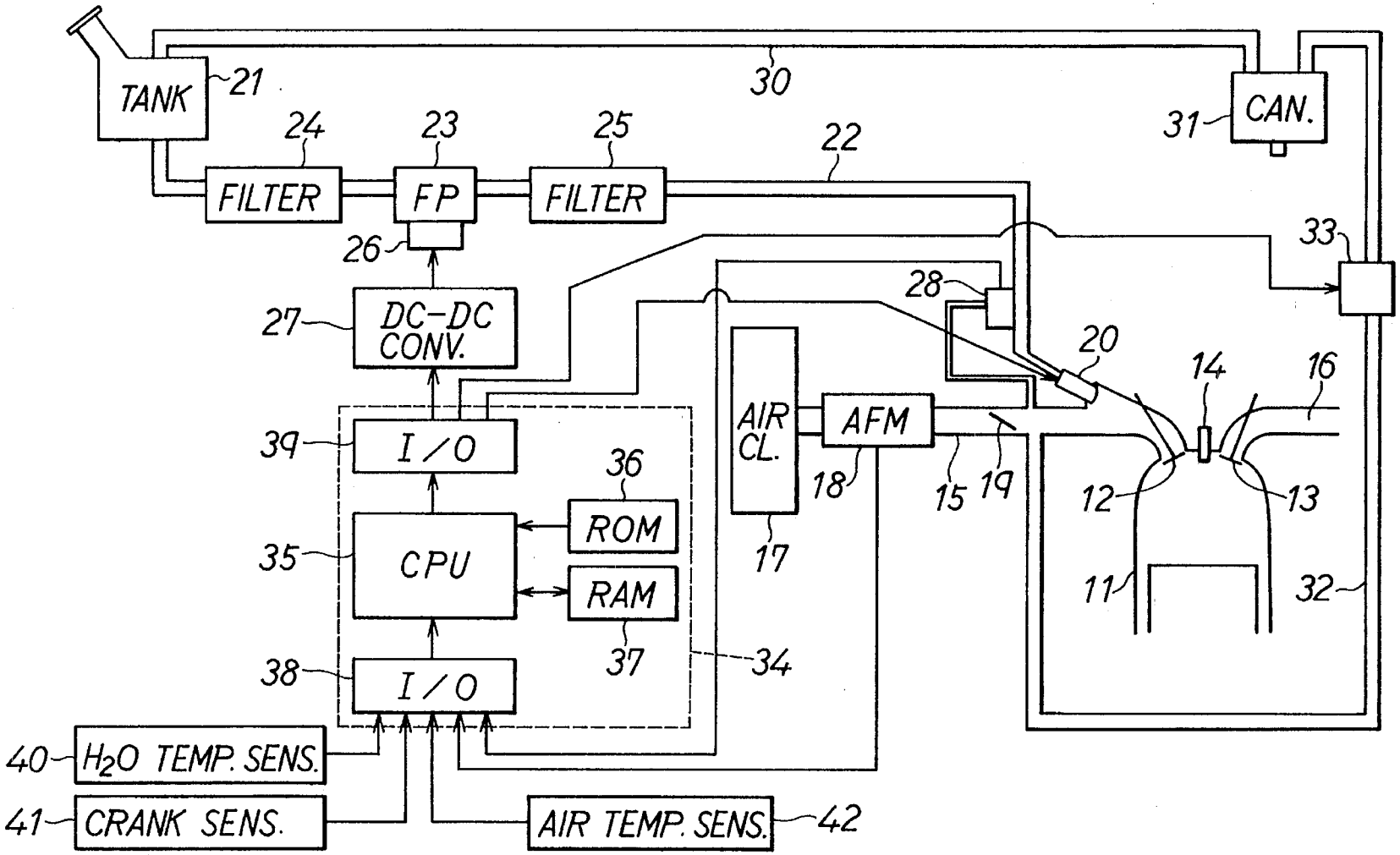
FIG. 1 is a schematic block diagram of the entire system of a first embodiment of the invention.

Referring to FIG. 1, the entire system construction of the first embodiment is made up as follows. An internal combustion engine 11 is provided with an intake valve 12, an exhaust valve 13 and a spark plug 14. The engine 11 is connected to an intake pipe 15 and an exhaust pipe 16. An air cleaner 17 is disposed upstream in the intake pipe 15. An air flow meter 18 detects the flow of air passing through the air cleaner 17. A throttle valve 19 and an injector 20 are provided downstream from the air flow meter 18 in the intake pipe 15.

A fuel supplying pipe 22 for supplying fuel to the injector 20 is connected to the bottom of a fuel tank 21. A fuel pump 23 is provided roughly in the middle of the fuel supplying pipe 22. Filters 24, 25 are provided upstream and downstream from the fuel pump 23. A differential pressure sensor 28 for detecting a pressure difference between the fuel pressure and the intake pipe pressure is provided farther downstream in the fuel supplying pipe 22. This fuel supplying system has a one-way flow construction that starts from the fuel tank 21 and ends at the injector 20 and that does not incorporate a return pipe or a pressure regulator, unlike a conventional construction. The fuel pump 23 is driven by a DC motor 26. The voltage applied to the DC motor 26 is variably controlled by using a DC-DC converter 27 to control the operating speed of the fuel pump 23 in order to control the fuel conveying pressure.

Fuel vapor from the fuel tank 21 is introduced through a passage 30 to a charcoal canister unit 31 that traps fuel vapor. The fuel vapor is purged from the canister unit 31 into the intake pipe 15 through a purge passage 32 by operating a fuel vapor purging valve 33 in accordance with operating conditions of the engine 11.

The fuel vapor purge is performed when predetermined purging conditions are met. Examples of the purging conditions are: elapse of a predetermined time following the starting of the engine 11; elapse of a predetermined time following the turning on of an idle switch (not shown); a current engine speed equaling or exceeding a predetermined value; and a current intake temperature equaling or exceeding a predetermined value. The quantity of fuel purged from the canister unit 31 (purge quantity) is controlled as follows. If an air-fuel ratio feedback correcting coefficient FAF equals or exceeds 1.0, that is, the air-fuel ratio deviates to the lean side, the fuel vapor purging valve 33 is duty-ratio controlled to increase the purge quantity as much as possible. If the air-fuel ratio feedback correcting coefficient FAF is less than 1.0, that is, the air-fuel ratio deviates to the rich side, the fuel vapor purging valve 33 is duty-ratio controlled to reduce the purge quantity.

A control circuit 34 is constituted mainly by a microcomputer comprising a CPU 35, a ROM 36, a RAM 37, and input/output interfaces 38, 39. The control circuit 34 receives information from various sensors, such as a coolant temperature sensor 40 for detecting a temperature of an engine coolant, a engine speed sensor 41 for detecting a crank angle for each cylinder of the engine 11, an intake temperature sensor 42 for detecting an intake temperature, the air flow meter 18 and the differential pressure sensor 28. Then, the control circuit 34 accordingly controls the injector 20, the motor 26 of the fuel pump 23, and the fuel vapor purging valve 33.

For example, if the fuel pressure detected by the differential pressure sensor 28 is not greater than a target pressure value (described below), the control circuit 34 controls the DC-DC converter 27 to increase the output voltage (the voltage applied to the motor 26) in order to increase the fuel flow caused by the fuel pump 23. On the other hand, if the fuel pressure detected by the differential pressure sensor 28 is greater than the target pressure value, the control circuit 34 controls the DC-DC converter 27 to reduce the output voltage.

Figure 2:
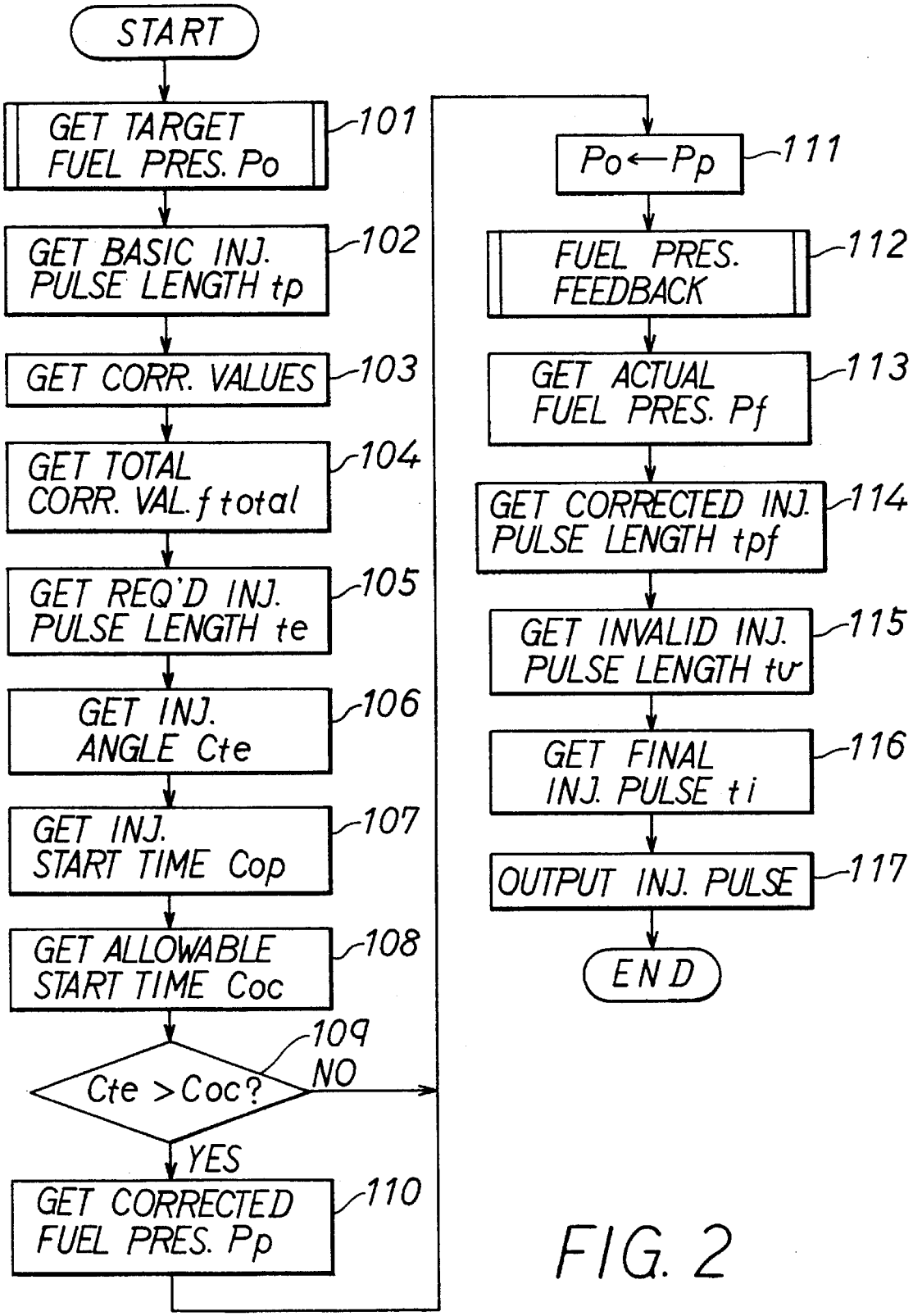
FIG. 2 is a flowchart illustrating an injection control program according to the first embodiment.

The control operation of the control circuit 34 will be described with reference to the flowchart of FIG. 2. The control program illustrated in FIG. 2 is repeatedly executed synchronously with 180 crank angle signals from the engine speed sensor 41. When the program is started, the control circuit 34 determines in Step 101 a target fuel pressure Po by executing a subroutine illustrated in FIG. 3 (the subroutine will be described later). Alternatively, this subroutine may be repeatedly executed at regular intervals, independently of the main program illustrated in FIG. 2.

Step 102 determines a basic injection pulse tp (basic injection time length) based on the intake air flow detected by the air flow meter 18 and the engine speed detected by the engine speed sensor 41. Alternatively, the basic injection pulse tp may be determined based on the intake pipe pressure and the engine speed, or the throttle valve opening and the engine speed. Step 103 determines various correction values for correcting the basic injection pulse tp, for example, a warm-up correction value in accordance with the output from the coolant sensor 40, a correction value used in accelerating or decelerating engine operation, or a feedback correction value for the stoichiometric air-fuel ratio. Step 104 calculates the total correction value (ftotal) by totaling these correction values.

Step 105 calculates a required injection pulse te (pulse length) based on the basic injection pulse tp and the total correction value ftotal by using the following Equation (1):

$$te=tp\times ftotal \quad (1)$$

Step 106 calculates a required injection angle Cte (CA) by using the following Equation (2):

$$Cte=\{(ms)\times \text{engine speed}(rpm)\times 360\}/(60\times 1000) \quad (2)$$

The required injection angle Cte must be determined because as the required injection pulse te is determined in a unit of time (millisecond), the crank angle corresponding to a given required injection pulse varies depending on the engine speed.

Step 107 computes an injection start timing Cop. The injection start timing may be predetermined as a suitable value, or may be determined by using a two-dimensional map based on the load (for example, using tp).and speed of the engine 11, or may be determined in other ways. The injection start timing Cop is expressed in crank angle. Step 108 computes an allowable injection angle Coc based on the injection start timing Cop and the opening timing of the intake valve 12 so as to prevent the blow-through of injected fuel into the exhaust system.

Injection must end before the opening timing of the intake valve 12 to prevent the blow-through. The intake valve opening timing Ccr (crank angle) is predetermined for the engine 11. Thus, the allowable injection angle Coc can be expressed by the difference between the injection start timing Cop and the intake valve opening timing Ccr. If injection ends within this period (the allowable injection angle Coc), that is, before the intake valve 12 opens, the blow-through will not occur. The injection start timing Cop and the intake valve opening timing Ccr are computed with respect to the cylinders for which fuel injection is simultaneously performed. That is, if the engine 11 is of individual-cylinder independent injection type, the allowable injection angle Coc must be determined separately for each cylinder. If the engine 11 is of simultaneous injection type or group-cylinder injection type, it is sufficient to determine an allowable injection angle Ccr for all the cylinders or a group of cylinders for which fuel injection is simultaneously performed.

Step 109 compares the allowable injection angle Coc with the required injection angle Cte to determine whether the injection end timing is earlier than the opening timing of the intake valve 12 (intake stroke). If Cte>Coc, that is, if the required injection angle Cte exceeds the allowable injection angle Coc, injection would continue into the intake stroke to cause the blow-through. Therefore, if Cte>Coc, operation proceeds to Step 110, where the target fuel pressure Po is corrected to obtain a corrected fuel pressure Pp. If the fuel pressure is increased, the quantity of fuel injected in response to a given injection pulse length will increase. Therefore, the increased fuel pressure will reduce the injection pulse length (the length of injection period) needed to provide the required fuel injection quantity. Accordingly, Step 110 determines a corrected fuel pressure Pp such that the injection will end before the intake valve 12 opens. Step 111 sets the corrected fuel pressure Pp as a new target fuel pressure Po to be used to determine a corrected required injection angle Cte.

Various techniques can be used to determine corrected fuel pressure Pp so as to prevent the blow-through.

In a first example manner, a fuel pressure is predetermined such that it will provide a corrected required injection angle Cte equal to or less than the allowable injection angle Coc even under the severest conditions where the allowable injection angle Coc reaches the smallest possible value. The predetermined fuel pressure value is used as the corrected fuel pressure Pp. This manner simplifies the control operation.

In a second example manner, the target fuel pressure Po is continuously varied to prevent the blow-through, but is not increased to unnecessary extents. More specifically, based on the finding that if the fuel pressure increases X times, the fuel injection quantity increases $X^{1/2}$ times, a corrected fuel pressure Pp is calculated as follows in Equation (3):

$$Pp=(Cte^2/Coc^2)\times\text{basic target fuel pressure} \quad (3)$$

Since Cte>Coc when this correction is required, the corrected fuel pressure Pp becomes greater than the basic target fuel pressure.

Figure 4:
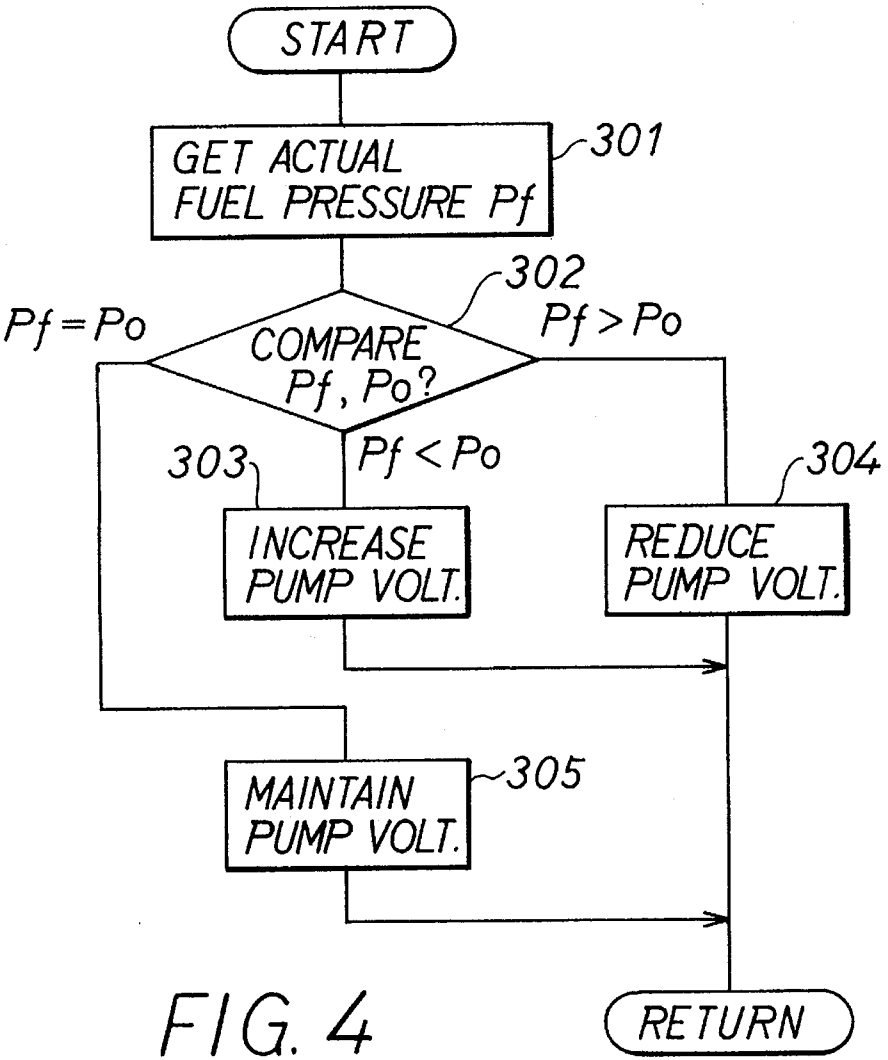
FIG. 4 is a flowchart illustrating a routine of fuel pressure feedback control according to the first embodiment.

After the corrected fuel pressure Pp thus determined is selected as a new target fuel pressure Po (Step 111), Step 112 executes a fuel pressure feedback subroutine described later (see FIG. 4). This subroutine may also be repeatedly executed at regular intervals, independently from the main program.

If Step 109 determines that the required injection angle Cte is equal to or less than the allowable injection angle (Cte≦Coc), correction of the target fuel pressure Po is skipped because the current target fuel pressure Po will cause the injection to end before the intake stroke starts so that the blow-through will not occur. Operation immediately proceeds to Step 112, where the fuel feedback subroutine is executed (see FIG. 4).

In Step 113, the differential pressure sensor 28 measures the current actual fuel pressure Pf. Step 114 corrects the required injection pulse te in accordance with the actual fuel pressure Pf. As described above, the required injection pulse te has been determined based on the basic target fuel pressure, and needs to be corrected in accordance with the actual fuel pressure Pf. The corrected injection pulse tpf is determined by using the following Equation (4):

$$tpf=(Pf/\text{basic target fuel pressure})^{1/2}\times te \quad (4)$$

Step 115 determines an invalid injection pulse tv corresponding to the battery voltage and the actual fuel pressure Pf based on a two-dimensional map. Step 116 determines a final injection pulse ti as follows in Equation (5):

$$ti=tpf+tv \quad (5)$$

where tpf is corrected injection pulse, and tv is the invalid injection pulse.

In Step 117, the control circuit 34 outputs a pulse in accordance with the final injection pulse ti. This program is thus completed.

The target pressure calculating routine executed in Step 101 will be described with reference to FIG. 3. This routine first determines whether the engine 11 is being started (Step 201), whether the elapsed time following the starting of the engine 11 is less than a predetermined length of time (Step 202), and whether the fuel temperature corresponds to a high-temperature state. These determination processings are performed to detect a condition that requires an increase in the target fuel pressure to prevent the hyper-vaporization of fuel. Step 201 determines that the engine 11 is being started, if the starter is on and the engine speed is equal to or less than a predetermined value. The predetermined length of time used in Step 202 is selected from, for example, a range of 1 to 10 minutes. Step 203 estimates a fuel temperature based on the measurements by the coolant temperature sensor 40 and the intake temperature sensor 42, and makes a determination based on the estimated fuel temperature and other factors. According to this embodiment, the coolant temperature sensor 40 and the intake temperature sensor 42 together function as a temperature information detecting unit for detecting information regarding fuel temperature. Alternatively, a sensor for directly detecting fuel temperature may be provided.

If it is determined through Steps 201 to 203 that the engine 11 is being started or has just started and that the fuel temperature corresponds to the high-temperature state, operation proceeds to Step 204. If not, operation proceeds to Step 205.

If the engine 11 is being started and the fuel temperature corresponds to the high-temperature state, or if the engine 11 has just started (that is, the elapsed time following the starting of the engine 11 is less than a predetermined length of time) and the fuel temperature corresponds to the high-temperature state, Step 204 determines a target fuel pressure Po in accordance with the fuel temperature. According to this embodiment, the target fuel pressure Po is determined using a two-dimensional map involving factors of the coolant temperature and the intake temperature as shown in FIG. 5. Alternatively, the target fuel pressure Po may be determined corresponding to the fuel temperature by using a one-dimensional map. The target fuel pressure Po determined in Step 204 is generally within a range of 250 to 500 KPa and equal to or greater than the basic target fuel pressure value described later.

On the other hand, if the predetermined length of time has elapsed following the starting of the engine 11, or if the fuel temperature does not correspond to the high-temperature state, Step 205 determines whether fuel purging is being performed. The "fuel purging" herein means purging of fuel vapor from the canister unit 31 into the intake pipe 15 by opening the fuel vapor purging valve 33. During the fuel purging, the injection pulse length may become less than the injector linearity limit indicated in FIG. 6 because the fuel vapor introduced from the canister unit 31 into the intake pipe 15 causes correction of the air-fuel ratio feedback control so as to reduce the final injection pulse ti. Thus, the determination regarding the fuel purging detects the possibility that the final injection pulse ti will becomes less than the injector linearity limit.

If Step 205 determines that the fuel purging is being performed, Step 206 determines whether the engine 11 is operated in a low-load operating region. The determination by Step 205 regarding the low-load operating region is needed because while in a high-load operating region, the final injection pulse ti is great so that the injection pulse length after the air-fuel ratio feedback correction is considerably greater than the injector linearity limit with an ample margin thereto, the margin relative to the injector linearity limit in the low-load operating region is very small. The "low-load operating region" herein means the idling region and a region adjacent to the idling region, that is, a region in which the basic injection pulse tp is equal to or less than a predetermined value and the engine speed is equal to or less than a predetermined value.

If Step 206 determines that the fuel purging is not being performed, operation proceeds to Step 207, where the target fuel pressure Po is determined as a basic target fuel pressure. The basic target fuel pressure is a standard fuel pressure used in occasions other than the case where the fuel pressure needs to be corrected, for example, when the engine 11 is restarred at a high temperature. As described above, the basic target fuel pressure is a basis for determining a required injection pulse te and the like. The basic target fuel pressure is determined generally within a range of 200 to 350 KPa.

If the fuel purging is being performed and the engine 11 is being operated in the low-load operating range, operation proceeds to Step 208, where a target fuel pressure Po is calculated in accordance with the flow of purged fuel vapor. A target fuel pressure Po is determined such that the minimum pulse length that is provided through the air-fuel ratio feedback correction when the purged fuel flow reaches the maximum value is greater than the injector linearity limit. For example, if the actual pulse length during the idling is 1.2 ms, the injector linearity limit is 1.0 ms in terms of pulse length, and the air-fuel ratio feedback correction due to the fuel purging is −40%, then the actual idling pulse would become 0.72 ms [=1.2×(100−40)/100]. To avoid this, the target fuel pressure Po is determined as a half the basic target fuel pressure to provide an actual idling pulse of 1.02 ms [$=0.72\times1/(1/2)^{1/2}$], which is greater than the injector linearity limit. Thus, Step 208 determines a target fuel pressure Po lower than the basic target fuel pressure in accordance with the purged fuel flow to maintain the injection pulse length at values equal to or greater than the injector linearity limit.

The fuel pressure ratio feedback routine will be described with reference to the flowchart of FIG. 4. This routine corresponds to the subroutine of the step 112 in the flowchart of FIG. 2. In the fuel pressure feedback routine, the differential pressure sensor 12 measures the current actual fuel pressure Pf in Step 301. Step 302 compares the actual fuel pressure Pf with the current target fuel pressure Po, that is, a target fuel pressure value obtained by the fuel pressure calculating routine shown in FIG. 3 or a corrected value obtained by correcting the target fuel pressure value in Steps 110 and 111.

If actual fuel pressure Pf=target fuel pressure Po, operation proceeds to Step 305, where the present pump applied voltage (that is, the voltage applied to the motor 26 of the fuel pump 23) is maintained. The routine is thus completed.

If actual fuel pressure Pf<target fuel pressure Po, operation proceeds to Step 303, where the output voltage of the DC-DC converter 27 is increased to increase the pump applied voltage so as to increase the pumping pressure of the fuel pump 23, that is, the output voltage of the DC-DC converter 27 is controlled to achieve Pf=Po. The routine is thus completed.

If actual fuel pressure Pf>target fuel pressure Po, operation proceeds to Step 304, where the output voltage of the DC-DC converter 27 is reduced to reduce the pump applied voltage so as to reduce the pumping pressure of the fuel pump 23, that is, the output voltage of the DC-DC converter 27 is controlled to achieve Pf=Po. The routine is thus completed.

Figures 8A, 8B, 8C:
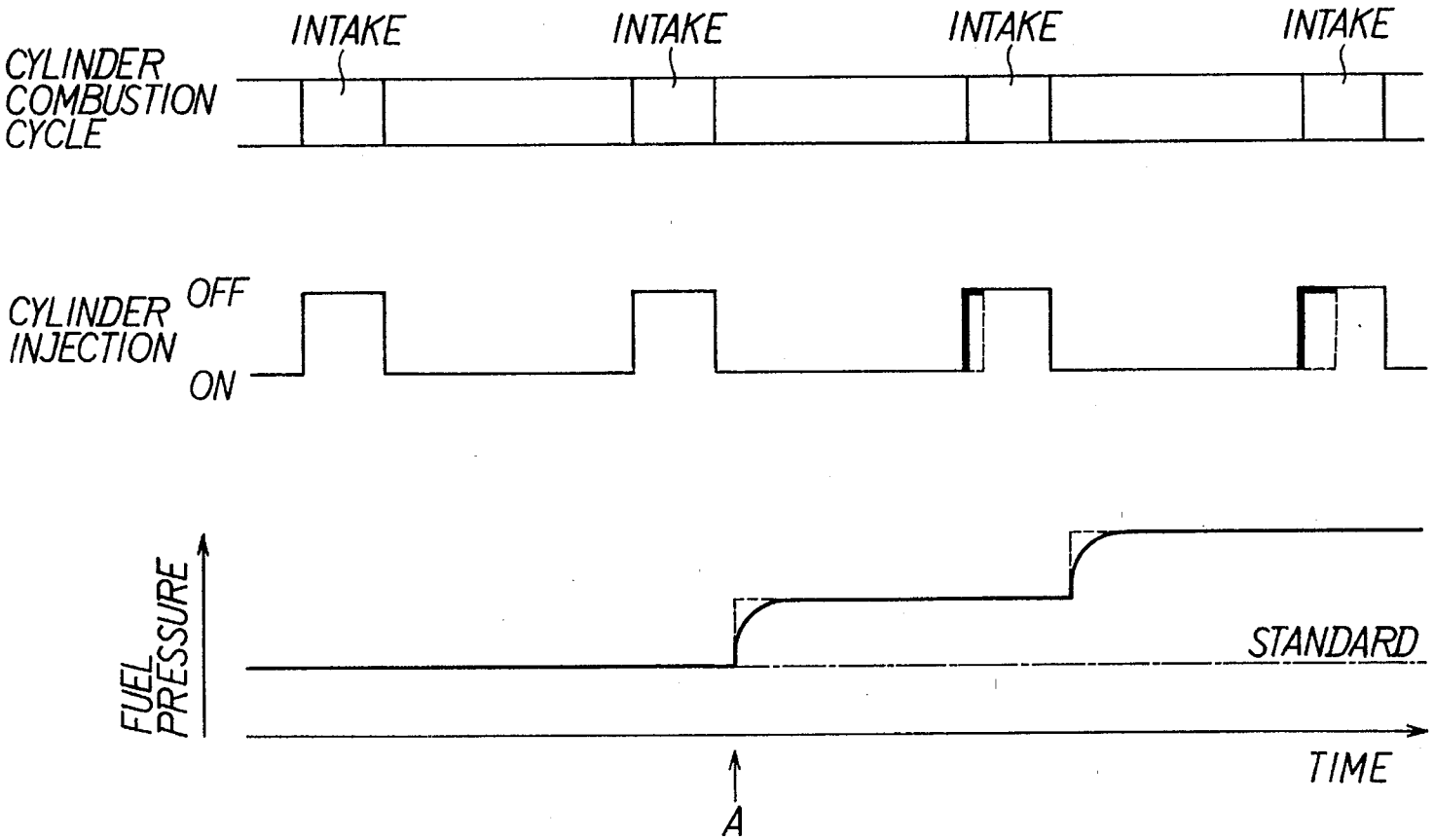
FIGS. 8A–8C are timing charts illustrating a fuel injection control operation in which the fuel injection quantity is increased while the engine speed remains constant.

An example case where the control program illustrated in FIG. 2 is executed will be described with reference to the timing charts of FIGS. 8A–8C. The timing chart refers to a case where the engine speed is maintained constant and the fuel injection quantity is increased. If it is determined by calculation that the next required injection pulse will overlap the intake stroke of FIG. 8A at point A in FIGS. 8A–8C, the target fuel pressure (denoted by the dotted line in FIG. 8C) is increased. Along with the increase of the target fuel pressure, the actual fuel pressure (denoted by the solid line in FIG. 8C) is also increased by the fuel pressure feedback routine illustrated in FIG. 4. The injection pulse length is reduced in accordance with the target fuel pressure to shift the injection end timing from the timing indicated by a broken line to the timing indicated by a solid line in FIG. 8B, thus finishing injection before the intake stroke. If the required fuel injection quantity is reduced, the target fuel pressure is reduced in accordance with the decrease of the required fuel injection quantity, within an extent such that the injection pulse discontinues before the intake stroke.

Figures 9A, 9B:
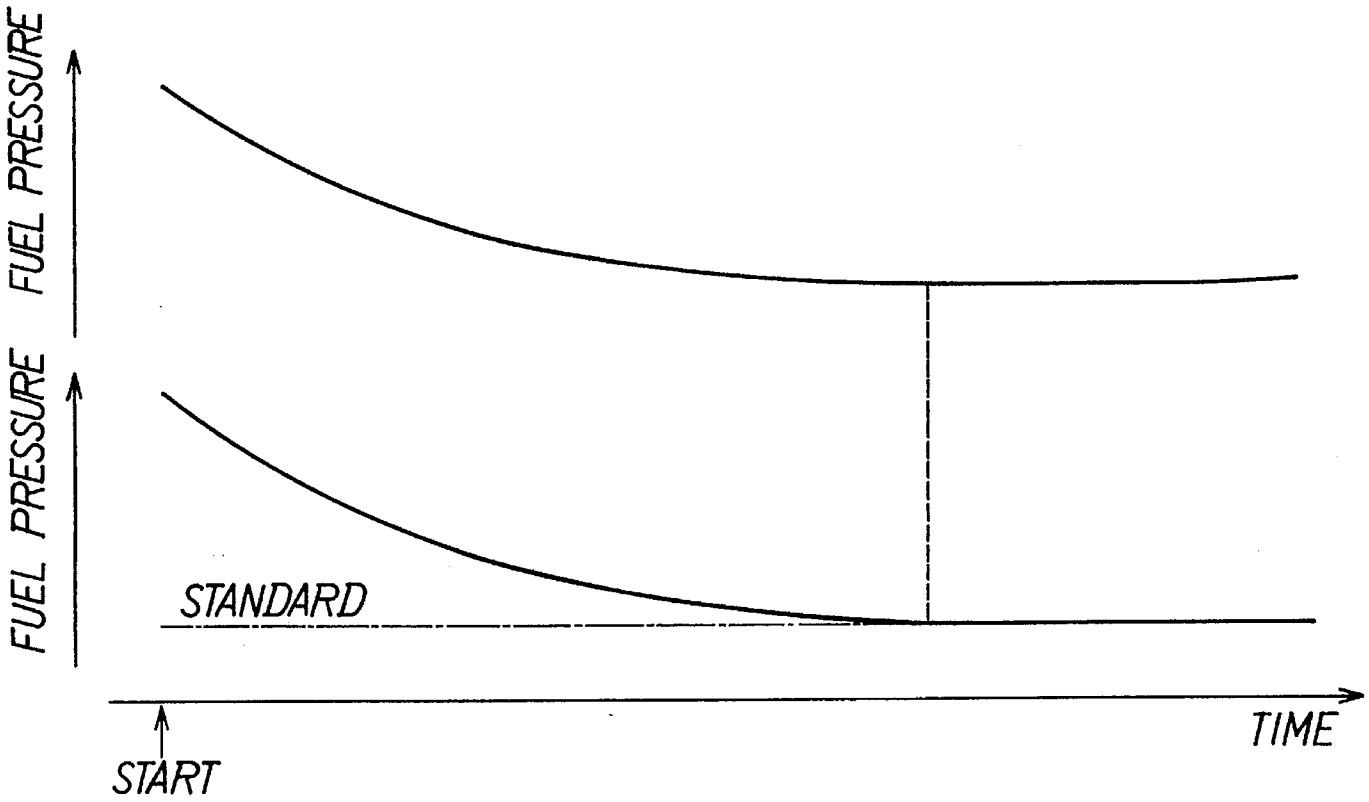
FIGS. 9A and 9B illustrate examples of fuel pressure control for high-temperature restarting operation.

In a high-temperature restart operation, when the fuel temperature (shown by the solid line of FIG. 9A) equals or exceeds a predetermined value, as indicated in FIG. 9, the target fuel pressure (=actual fuel pressure) shown by the solid line of FIG. 9B) is increased as the fuel temperature increases, in order to prevent the hyper-vaporization. When the fuel temperature becomes equal to or less than the predetermined value, the target fuel pressure (=actual fuel pressure) is maintained at a constant level (except for the cases indicated in FIGS. 8A–8C and 10A–10C).

Figures 10A, 10B, 10C:
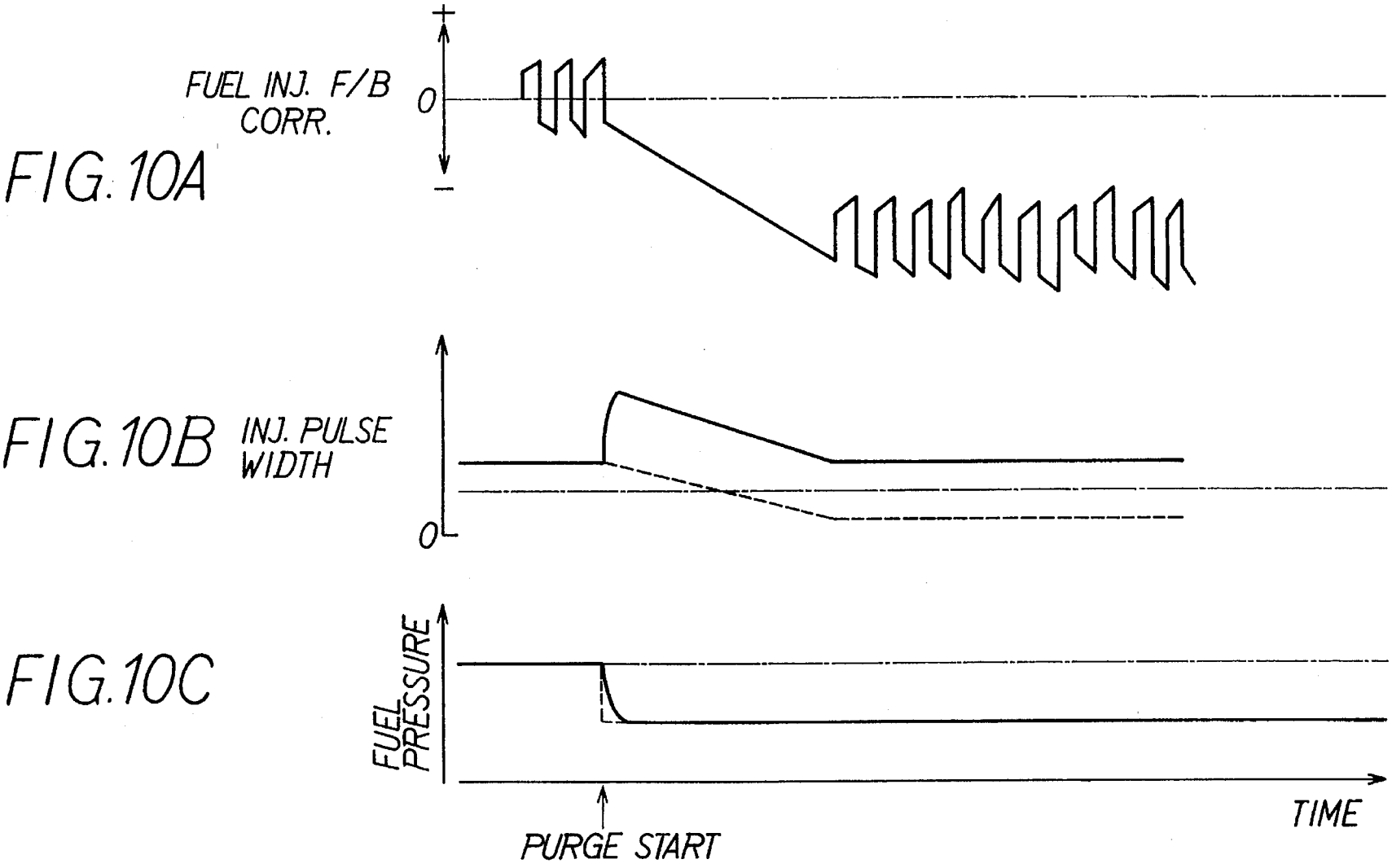
FIGS. 10A–10C are timing charts illustrating the control status while fuel vapor is purged from the canister.

Art example case of control operation during the fuel purging will be described with reference the timing chart of FIGS. 10A–10C. Since the fuel purging shifts the air-fuel ratio to the rich side as shown in FIG. 10A, the air-fuel ratio feedback correction value is shifted toward the lean side and the injection pulse length is reduced as shown in FIG. 10B. Therefore, the basic target fuel pressure would provide an injection pulse length that is less than the injector minimun linearity limit as shown by the dotted line of FIG. 10B.

To avoid this, the target fuel pressure is reduced as shown by the solid line in FIG. 10C to increase the actual injection pulse length as shown by the solid line in FIG. 10B. Although the actual injection pulse length is reduced by the air-fuel feedback correction to some extent, it will not become less than the injector linearity limit. Optionally, the target fuel pressure may be continuously varied in accordance with the required injection pulse length at the basic target fuel pressure or the air-fuel ratio feedback correction value, within an extent such that the target fuel pressure remains equal to or greater than the injector linearity limit.

As described above, since the first embodiment determines a target fuel pressure in accordance with engine operating conditions, controls the voltage applied to the motor 26 of the fuel pump 23 in accordance with the target fuel pressure to adjust the pumping pressure of the pump 23 so that the actual fuel pressure equals the target fuel pressure, the embodiment can employ a simplified piping arrangement in which a return pipe and a pressure regulator are omitted unlike the conventional art, and variably control the fuel pressure in accordance with engine operating conditions, thus expanding the controllable engine operating regions.

Figures 7A, 7B, 7C:
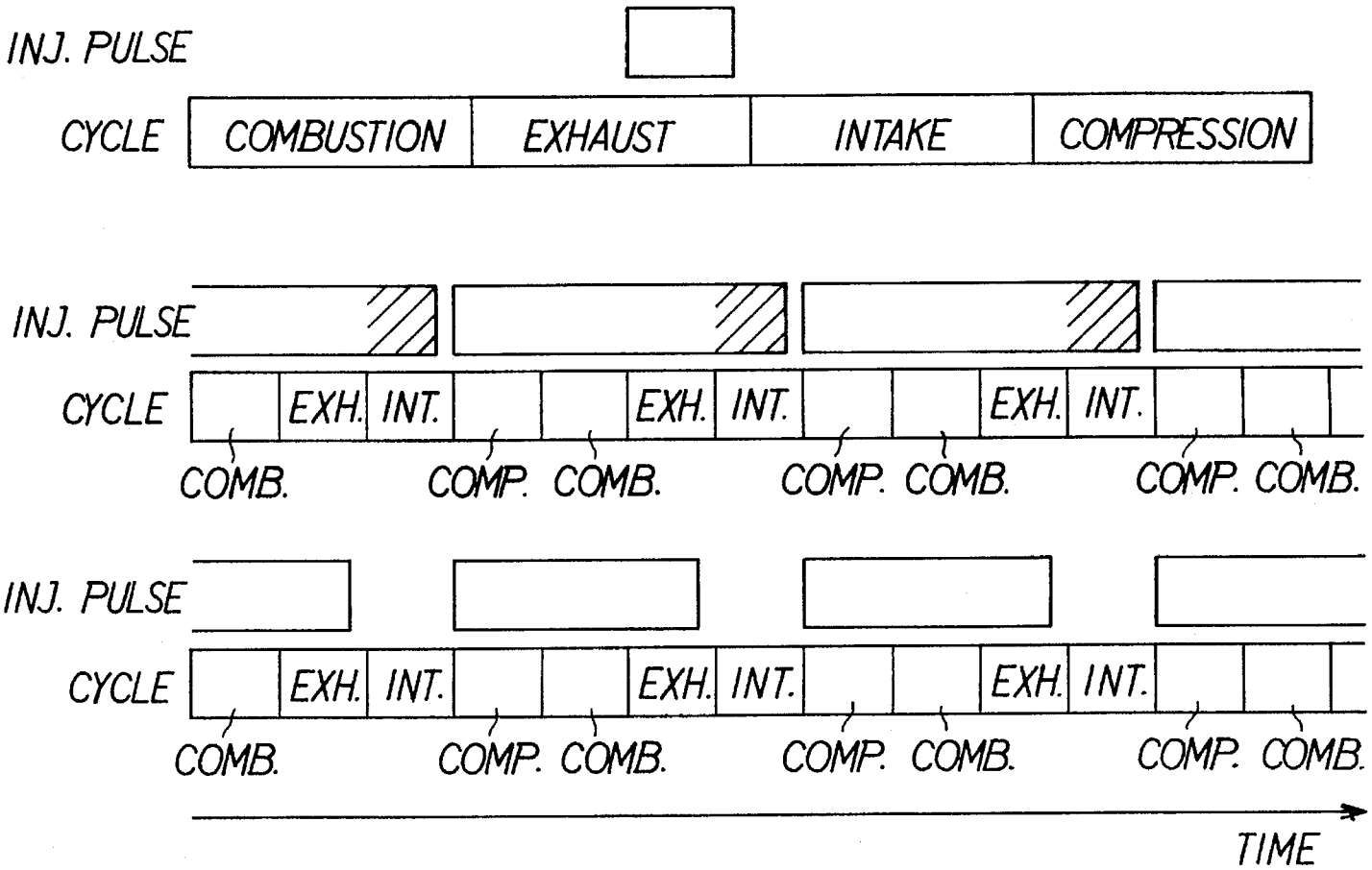
FIG. 7B (PRIOR ART)
FIGS. 7A–7C are timing charts illustrating the correspondence of injection pulses to the engine strokes for a low-speed, low-load case; a high-speed, high-load case according to the prior art; and a high-speed, high-load case according to the present invention, respectively.

Furthermore, since the first embodiment determines a target fuel pressure that allows the fuel injection end timing to become earlier than the opening timing of the intake valve 12 if it has been determined that the fuel injection end timing is later than the intake valve opening timing (the intake stroke), the embodiment can complete fuel injection before the intake stroke even during the high-speed and high-load engine operation as illustrated in FIG. 7C. Therefore, the embodiment unfailingly prevents the blow-through, that is, prevents contamination of unburned mixture in the emission.

In addition, the embodiment determines a target fuel pressure in accordance with the fuel temperature, considering the fact that as the fuel temperature increase or as the fuel pressure decreases, fuel vaporization more readily occurs. Thus, the embodiment efficiently prevents hyper-vaporization of fuel to improve the startability in the high-temperature restart operation.

Figure 6:
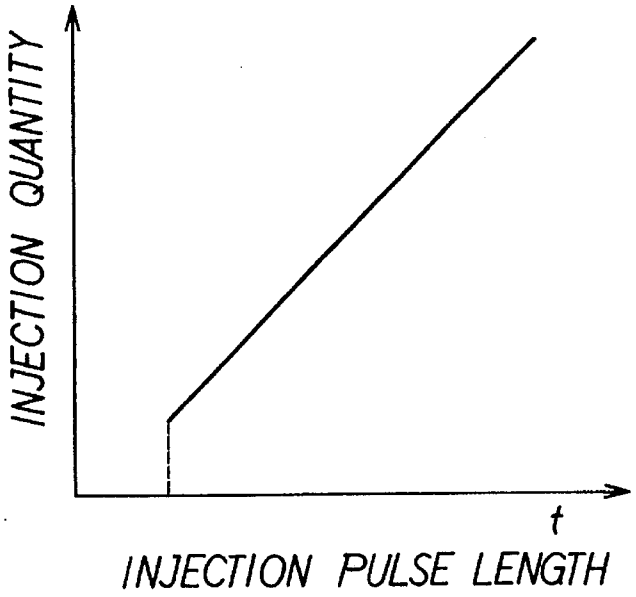
FIG. 6 is a graph indicating the relationship between the injection pulse length and the fuel injection quantity.

Further, the embodiment reduces the target fuel pressure in accordance with the flow of fuel vapor purged from the canister unit 31 into the intake pipe 15, considering a general characteristic that as the flow of purged fuel vapor increases, the injection pulse length is reduced by air-fuel ratio feedback to such an extent that the injection pulse length may become less than the linearity limit indicated in FIG. 6. The embodiment increases the injection pulse length in accordance with the flow of purged fuel vapor, thus performing injection control with an ample margin to the linearity limit.

Further, the embodiment reduces the target fuel pressure in the low-load operating region, considering a general characteristic that the fuel injection quantity is reduced and the injection pulse length is also reduced in the low-load operating region. That is, the embodiment can increase the injection pulse length by reducing the target fuel pressure in the low-load operating region, thus performing injection control with an ample margin to the linearity limit.

The first embodiment limits the period during which the target fuel pressure is corrected in accordance with the fuel temperature if the fuel temperature corresponds to the high-temperature state, to the period when the engine 11 is being started and the predetermined length of time after the engine 11 has started. However, this limitation may be omitted. For example, the target fuel pressure may be determined by referring to the fuel temperature during the entire engine operation.

Although the first embodiment uses the differential pressure sensor 28 to detect the fuel pressure, the fuel pressure may be determined in other ways.

Figure 11:
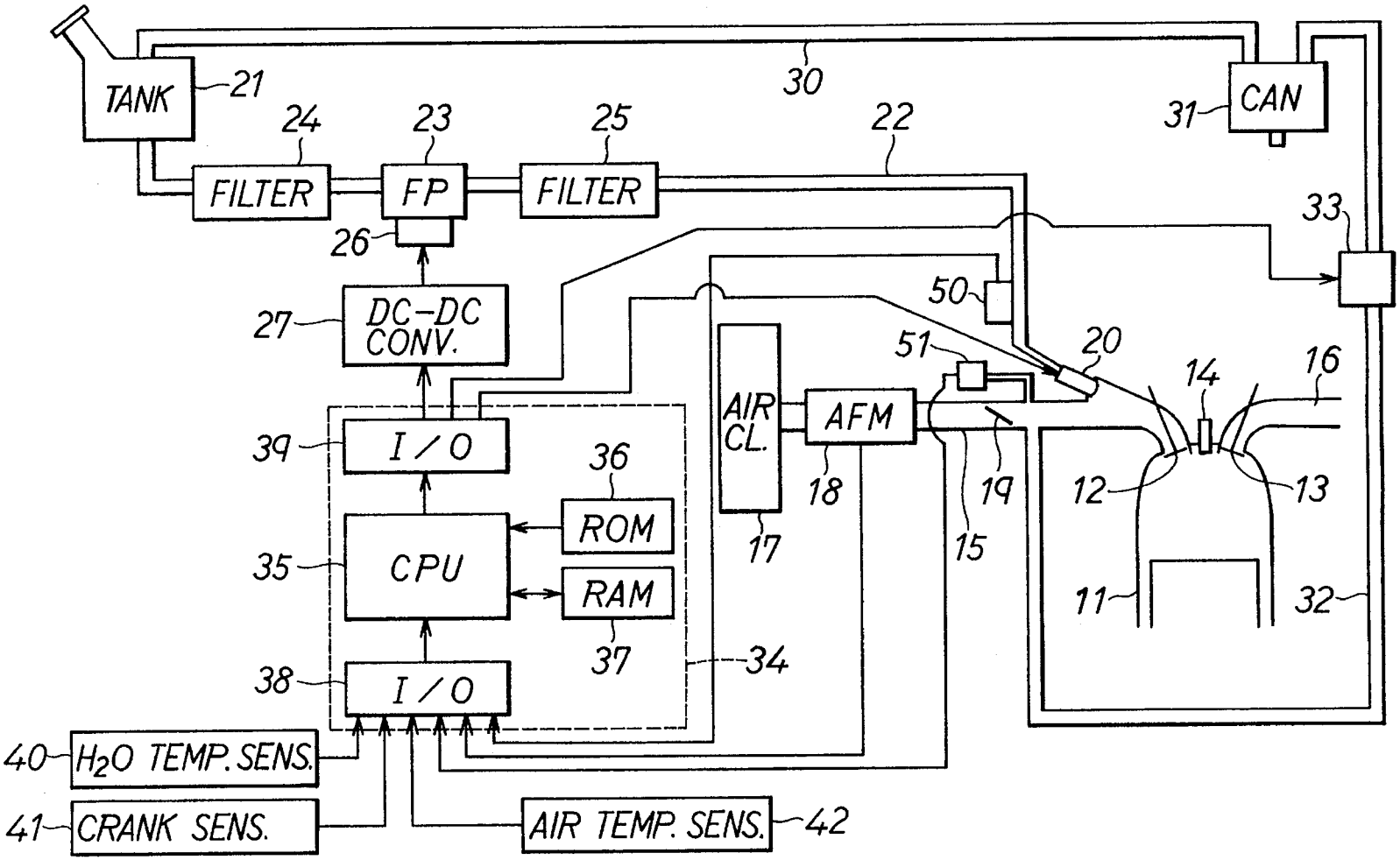
FIG. 11 is a schematic block diagram of the entire system of a second embodiment of the invention.

For example, a second embodiment of the invention as shown in FIG. 11 comprises a fuel pressure sensor 50 for detecting absolute pressure of the fuel supplied to the injector 20, and an intake pipe pressure sensor 51 for detecting intake pipe pressure. The second embodiment obtains a fuel pressure by calculating the difference between the absolute fuel pressure and the intake pipe pressure.

Figure 12:
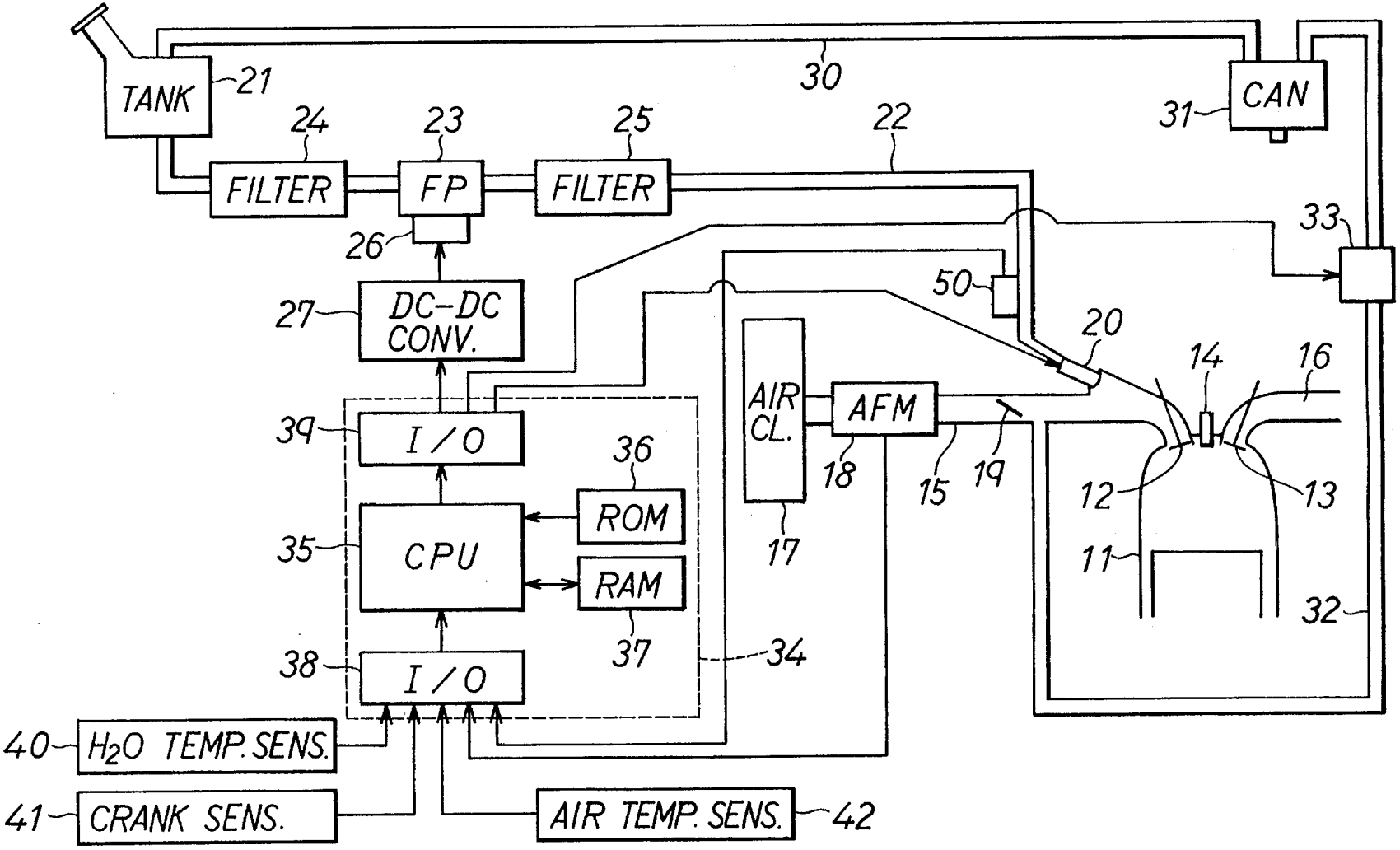
FIG. 12 is a schematic block diagram of the entire system of a third embodiment of the invention.
Figure 15:
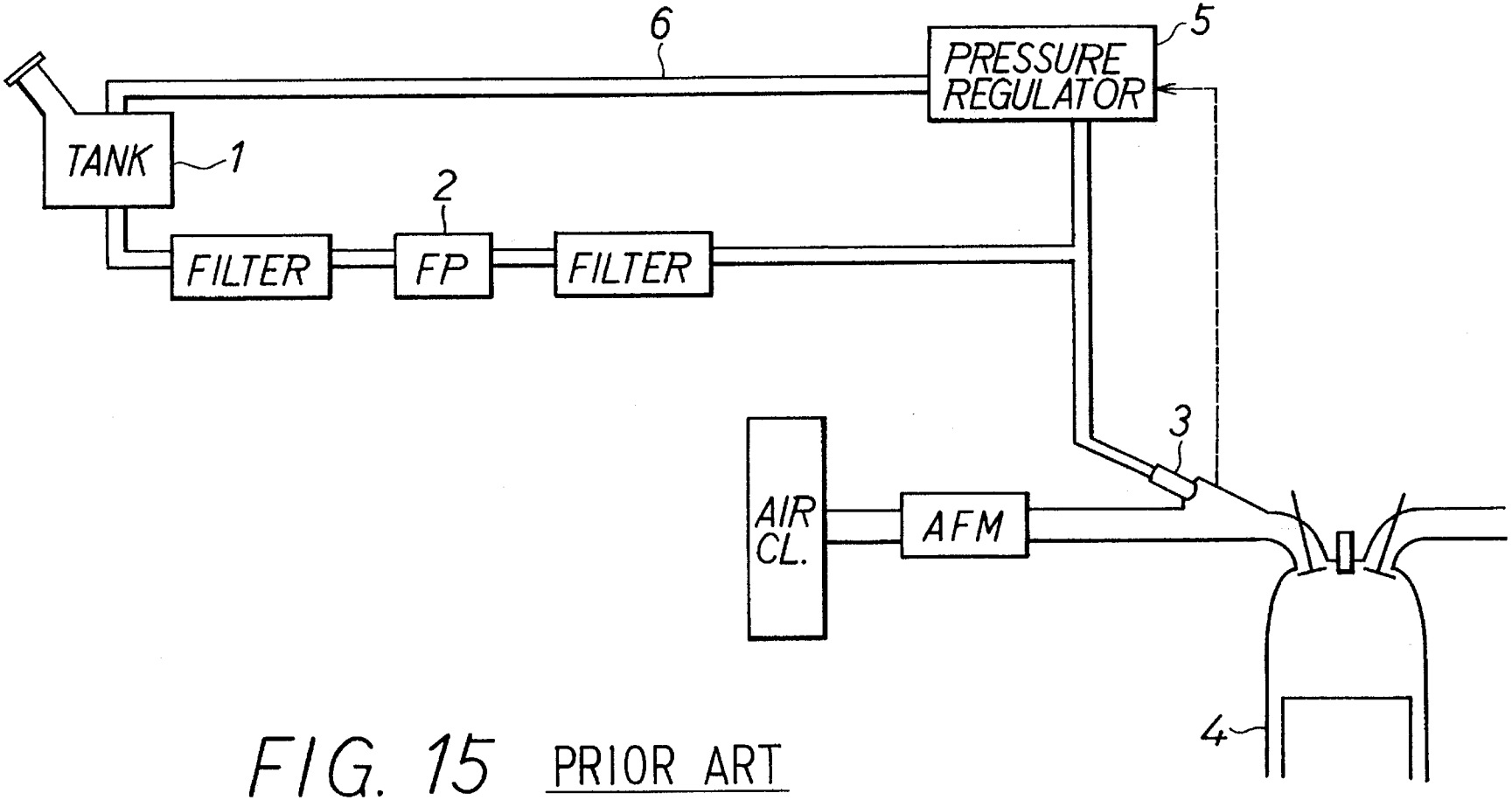
FIG. 15 PRIOR ART
FIG. 15 is a block diagram of the construction of a conventional fuel injection system.

In addition, a third embodiment of the invention as shown in FIG. 12 comprises a fuel pressure sensor 50 for detecting absolute fuel pressure but does not comprise an intake pipe pressure sensor. The third embodiment estimates an intake pipe pressure based on other information, and obtains a fuel pressure by calculating the difference between the detected absolute fuel pressure and the estimated intake pipe pressure. The intake pipe pressure can be computed corresponding to, for example, the intake air flow determined by the air flow meter 18 and the engine speed determined by the engine speed sensor 41, by using a two-dimensional map as illustrated in FIG. 13. The basic injection pulse tp or the throttle valve opening may be used instead of the intake air flow to compute the intake pipe pressure.

According to the above embodiments, the voltage applied to the motor 26 of the fuel pump 23 is varied by the DC-DC converter 27 to control the fuel pressure. However, the fuel pressure may be controlled in other manners. For example, the pumping pressure (fuel pressure) of the fuel pump 26 may be controlled by a PWM control method in which the duty ratio regarding the energization of the motor 26 is controlled to vary the average voltage to the motor 26.

Figure 3:
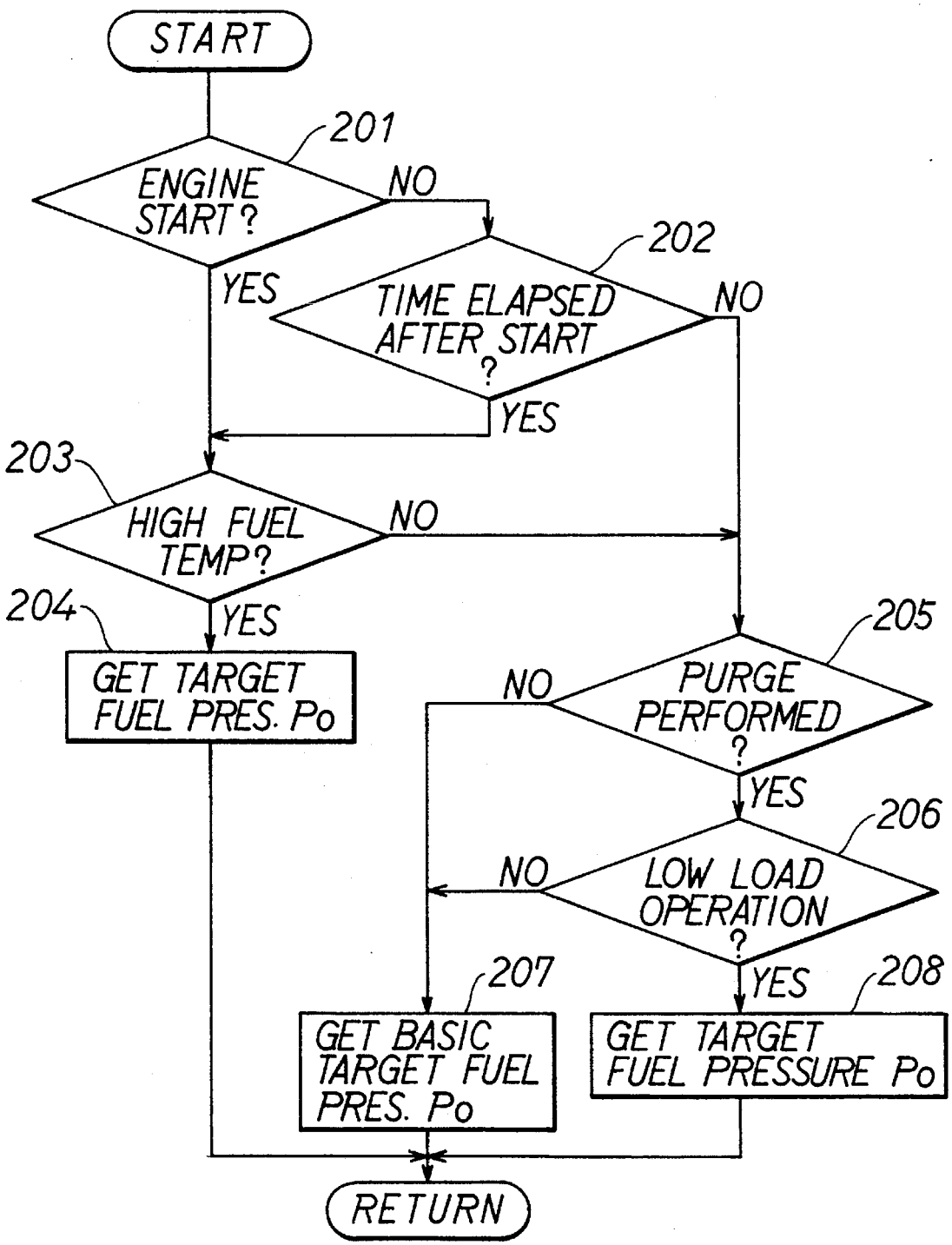
FIG. 3 is a flowchart illustrating a routine of target fuel pressure calculation according to the first embodiment.

According to a fourth embodiment, the fuel pressure determined in Step 207 in FIG. 3 according to the first embodiment is determined corresponding to the engine speed and the engine load (the intake air flow according to this embodiment) by using a map as illustrated in FIG. 14. In the map according to the fourth embodiment, the fuel pressure increases as the engine load (the intake air flow) increases. The throttle valve opening, the intake pipe pressure or the like may be used instead of the intake air flow to represent the engine load. This processing will determine an optimal basic target fuel pressure in accordance with the engine speed and the engine load. In addition, since the map is prepared such that higher engine loads correspond to higher fuel pressures, the fourth embodiment efficiently prevent undesired event in which fuel injection is not completed in one stroke during the high-load operation (when the fuel injection duration is increased, and the time length of one stroke is reduced).

While the present invention has been described with reference to what are presently considered to be preferred embodiments thereof, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fuel supplying apparatus for an internal combustion engine that supplies fuel from a fuel tank to an injector by using a fuel pump and injects fuel from the injector into the engine, the apparatus comprising:

variable speed driving means for variably controlling pumping pressure of the fuel pump;

temperature information detecting means for detecting information regarding fuel temperature;

fuel pressure control means for controlling the variable speed driving means so that the pressure of fuel to be injected by the injector becomes substantially equal to a fuel pressure determined in accordance with an operating condition of the engine and the information regarding fuel temperature detected by the temperature information detecting means;

fuel injection timing determining means for determining whether fuel injection end timing is earlier than intake valve opening timing;

wherein the fuel pressure control means includes means for controlling the variable speed driving means so that when the injection timing determining means determines that the fuel injection end timing is later than the intake valve opening timing, the pressure of fuel to be injected becomes substantially equal to a fuel pressure that allows the fuel injection end timing to become earlier than the intake valve opening timing.

2. A fuel supplying apparatus according to claim 1, wherein the fuel pressure control means includes means for controlling the variable speed driving means so that when the information regarding fuel temperature detected by the temperature information detecting means equals or exceeds a predetermined value, the pressure of fuel to be injected becomes substantially equal to a fuel pressure determined in accordance with at least the fuel temperature.

3. A fuel supplying apparatus according to claim 1, wherein the fuel pressure control means includes means for controlling the variable speed driving means so that as the fuel temperature detected by the temperature information detecting means increases, the pressure of fuel to be injected increases.

4. A fuel supplying apparatus according to claim 1, further comprising:

high-temperature restart determining means for determining whether current operation of the engine corresponds to a high-temperature restarting operation;

wherein the fuel pressure control means includes means for controlling the variable speed driving means so that when the high-temperature restart determining means determines that the current operation of the engine corresponds to the high-temperature restarting operation, the pressure of fuel to be injected becomes substantially equal to a fuel pressure determined in accordance with at least the information regarding fuel temperature detected by the temperature information detecting means, and then, as the fuel temperature decreases, the pressure of fuel to be injected gradually decreases.

5. A fuel supplying apparatus according to claim 1, further comprising:

operating region determining means for determining whether the current operation of the engine is in a low-load operating region;

wherein the fuel pressure control means includes means for controlling the variable speed driving means so that when the current operation of the engine is in the low-load operating region, the pressure of fuel to be injected decreases.

6. A fuel supplying apparatus according to claim 1, wherein the operating condition of the engine includes revolution speed and load of the engine.

7. A fuel supplying apparatus according to claim 1, wherein the fuel pressure control means includes means for controlling the variable speed driving means so that as load of the engine increases, the pressure of fuel to be injected increases.

8. A fuel supplying apparatus for an internal combustion engine that supplies fuel from a fuel tank to an injector by using a fuel pump and injects fuel from the injector into the engine, the apparatus comprising:

variable speed driving means for variably controlling pumping pressure of the fuel pump;

temperature information detecting means for detecting information regarding fuel temperature;

fuel pressure control means for controlling the variable speed driving means so that the pressure of fuel to be injected by the injector becomes substantially equal to a fuel pressure determined in accordance with an operating condition of the engine and the information regarding fuel temperature detected by the temperature information detecting means;

a canister for trapping fuel vapor from the fuel tank; and fuel vapor purging means for purging fuel vapor from the canister into an intake passage of the engine;

wherein the fuel pressure control means includes means for controlling the variable speed driving means so that the pressure of fuel to be injected is reduced in accordance with flow of fuel vapor purged by the fuel vapor purging means.

9. A fuel supplying apparatus according to claim 8, wherein the fuel pressure control means includes means for controlling the variable speed driving means so that when the information regarding fuel temperature detected by the temperature information detecting means equals or exceeds a predetermined value, the pressure of fuel to be injected becomes substantially equal to a fuel pressure determined in accordance with at least the fuel temperature.

10. A fuel supplying apparatus according to claim 8, wherein the fuel pressure control means includes means for controlling the variable speed driving means so that as the fuel temperature detected by the temperature information detecting means increases, the pressure of fuel to be injected increases.

11. A fuel supplying apparatus according to claim 8, further comprising:

high-temperature restart determining means for determining whether current operation of the engine corresponds to a high-temperature restarting operation;

wherein the fuel pressure control means includes means for controlling the variable speed driving means so that when the high-temperature restart determining means determines that the current operation of the engine corresponds to the high-temperature restarting operation, the pressure of fuel to be injected becomes substantially equal to a fuel pressure determined in accordance with at least the information regarding fuel temperature detected by the temperature information detecting means, and then, as the fuel temperature decreases, the pressure of fuel to be injected gradually decreases.

12. A fuel supplying apparatus according to claim 8, further comprising:

operating region determining means for determining whether the current operation of the engine is in a low-load operating region;

wherein the fuel pressure control means includes means for controlling the variable speed driving means so that when the current operation of the engine is in the low-load operating region, the pressure of fuel to be injected decreases.

13. A fuel supplying apparatus according to claim 8, wherein the operating condition of the engine includes revolution speed and load of the engine.

14. A fuel supplying apparatus according to claim 8, wherein the fuel pressure control means includes means for controlling the variable speed driving means so that as load of the engine increases, the pressure of fuel to be injected increases.

15. An internal combustion engine fuel supplying apparatus for supplying fuel from a fuel tank to an injector by using a fuel pump and for injecting fuel from said injector into said engine, said apparatus comprising:

variable speed driving means for variably controlling a pumping pressure of said fuel pump;

fuel injection timing determining means for determining whether a fuel injection end timing of said injector is earlier than a intake valve opening timing of a respective intake valve in said internal combustion engine;

fuel pressure control means for controlling said variable speed driving means so that when said injection timing determining means determines that said fuel injection end timing is later than said intake valve opening timing, a pressure of fuel to be injected via said injector becomes substantially equal to a fuel pressure that allows said fuel injection end timing to become earlier than said intake valve opening timing.

16. An internal combustion engine fuel supplying apparatus for supplying fuel from a fuel tank to an injector by using a fuel pump and for injecting fuel from said injector into said engine, said apparatus comprising:

variable speed driving means for variably controlling a pumping pressure of said fuel pump;

fuel vapor purging means for purging fuel vapor from a canister into an intake passage of said engine; and fuel pressure control means for controlling said variable speed driving means so that a pressure of fuel to be injected by said injector is reduced in accordance with a flow of fuel vapor purged by said fuel vapor purging means.

* * * * *